US010001312B2

(12) United States Patent
Nuss et al.

(10) Patent No.: US 10,001,312 B2
(45) Date of Patent: Jun. 19, 2018

(54) WATER SUPPLY SYSTEM FOR AN ICE MAKING ASSEMBLY

(71) Applicant: General Electric Company, Schenectady, NY (US)

(72) Inventors: Bart Andrew Nuss, Fisherville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 306 days.

(21) Appl. No.: 15/006,216

(22) Filed: Jan. 26, 2016

(65) Prior Publication Data

US 2017/0211863 A1 Jul. 27, 2017

(51) Int. Cl.

| | |
|---|---|
| ***F25C 5/14*** | (2006.01) |
| ***F25C 1/22*** | (2018.01) |
| ***F25C 1/14*** | (2018.01) |

(52) U.S. Cl.

CPC ..... *F25C 1/225* (2013.01); *F25C 1/147* (2013.01); *F25C 1/25* (2018.01); *F25C 2700/04* (2013.01)

(58) Field of Classification Search

CPC ..... F25C 1/225; F25C 1/24; F25C 2500/08; F25C 2700/14; F25C 2700/04; F25C 1/147; F25D 11/02; F25D 17/065; F25D 23/04

See application file for complete search history.

(56) References Cited

U.S. PATENT DOCUMENTS 3,403,526 A * 10/1968 Brindley ..... F25C 1/147 62/188
3,791,166 A * 2/1974 Maleck ..... F25C 1/08 62/138

FOREIGN PATENT DOCUMENTS

KR 101037197 B1 5/2011

* cited by examiner

*Primary Examiner* — Elizabeth Martin
(74) *Attorney, Agent, or Firm* — Dority & Manning, P.A.

(57) ABSTRACT

A water switch assembly for a nugget ice making assembly is provided. The ice making assembly includes a hollow auger rotatably mounted within a reservoir and configured for extruding ice. The water switch assembly extends vertically through the center of the ice making auger and reservoir. The water switch assembly is in fluid communication with a water inlet and includes a float for measuring the water level. In this manner, the water switch assembly is configured to control the level of water within the reservoir.

20 Claims, 9 Drawing Sheets

WATER SUPPLY SYSTEM FOR AN ICE MAKING ASSEMBLY

FIELD OF THE INVENTION

The present subject matter relates generally to ice makers, such as nugget style ice makers, and water supply systems for the same.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate, scrape ice off an inner surface of the mold body, and force it through an extruder to form ice nuggets. Such ice makers are generally referred to as nugget style ice makers. Certain consumers prefer nugget style ice makers and their associated ice nuggets.

In certain nugget ice makers, water is supplied to the mold body from a reservoir that is remote from the mold body. Water from the remote reservoir may enter the mold body through a water inlet positioned on the mold body, e.g., commonly at the bottom of the mold body. The remote reservoir may also have a float for controlling the water level in the reservoir and in the mold body. However, because the mold body is maintained at a temperature below the freezing point of water, water entering the mold body often freezes and clogs the water inlet. A heater may be positioned near the water inlet to ensure that water entering the mold body does not freeze, but this may result in imbalanced cooling of the mold body and reduced ice maker efficiency. In addition, such a construction requires additional parts, increases cost, and prolongs assembly time. The resulting ice maker therefore has a larger footprint, requires additional components, and exhibits decreased performance and efficiency.

Accordingly, a refrigerator appliance having an ice making assembly with an improved water supply system would be useful. More particularly, a water supply system that requires fewer parts, has a smaller footprint, and exhibits improved performance and efficiency would be particularly beneficial.

BRIEF DESCRIPTION OF THE INVENTION

The present subject matter provides a water switch assembly for a nugget ice making assembly. The ice making assembly includes a hollow auger rotatably mounted within a reservoir and configured for extruding ice. The water switch assembly extends vertically through the center of the ice making auger and reservoir. The water switch assembly is in fluid communication with a water inlet and includes a float for measuring the water level. In this manner, the water switch assembly is configured to control the level of water within the reservoir. Additional aspects and advantages of the invention will be set forth in part in the following description, or may be apparent from the description, or may be learned through practice of the invention.

In a first exemplary embodiment, an ice making assembly that defines a vertical direction is provided. The ice making assembly includes a casing in thermal communication with a sealed system, the interior of the casing defining a reservoir configured to receive water. An auger assembly is rotatably mounted within the casing. The auger assembly includes a hollow auger shaft, an auger head disposed on the auger shaft and defining an auger cavity in fluid communication with the reservoir, and a motor operably coupled with the auger shaft and configured for selectively rotating the auger assembly within the casing. The ice making assembly further includes a water switch assembly configured for controlling the water level within the auger cavity and the reservoir. The water switch assembly includes a switch head assembly having a water inlet in fluid communication with a water supply and configured to provide the auger cavity with water, a switch shaft extending from the switch head assembly through the hollow auger shaft, and a float slidably received on the switch shaft within the auger cavity, the float configured to measure the water level within the auger cavity.

In a second exemplary embodiment, a water switch assembly for an ice making assembly is provided. The ice making assembly includes an auger rotatably mounted in a reservoir defined by a casing, the auger being disposed on an auger shaft and defining an auger cavity in fluid communication with the reservoir. The water switch assembly includes a switch head assembly having a water inlet in fluid communication with a water supply and configured to provide the auger cavity with water, a switch shaft extending from the switch head assembly through the auger shaft, and a float slidably received on the switch shaft within the auger cavity, the float configured to measure the water level within the auger cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
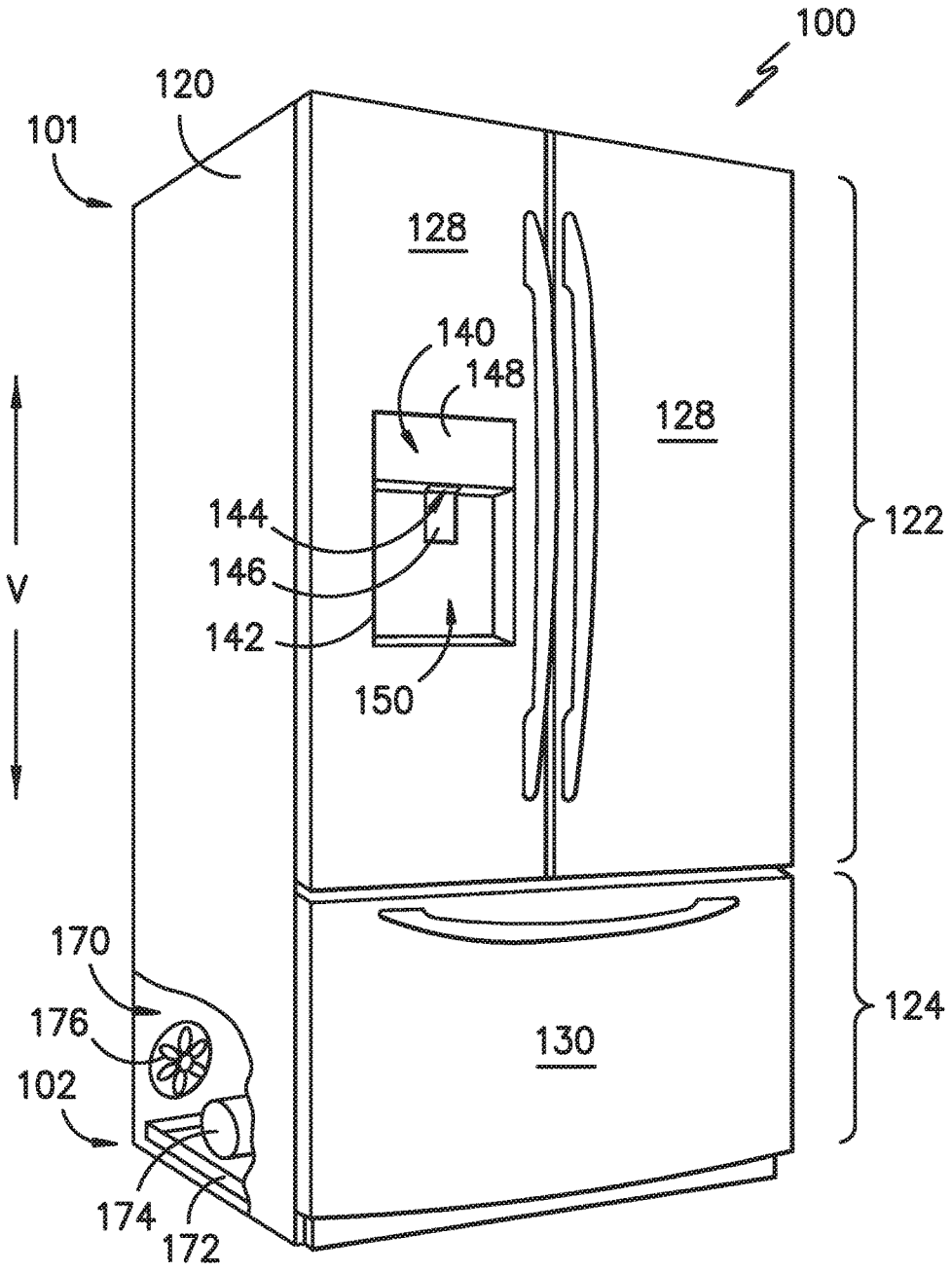
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
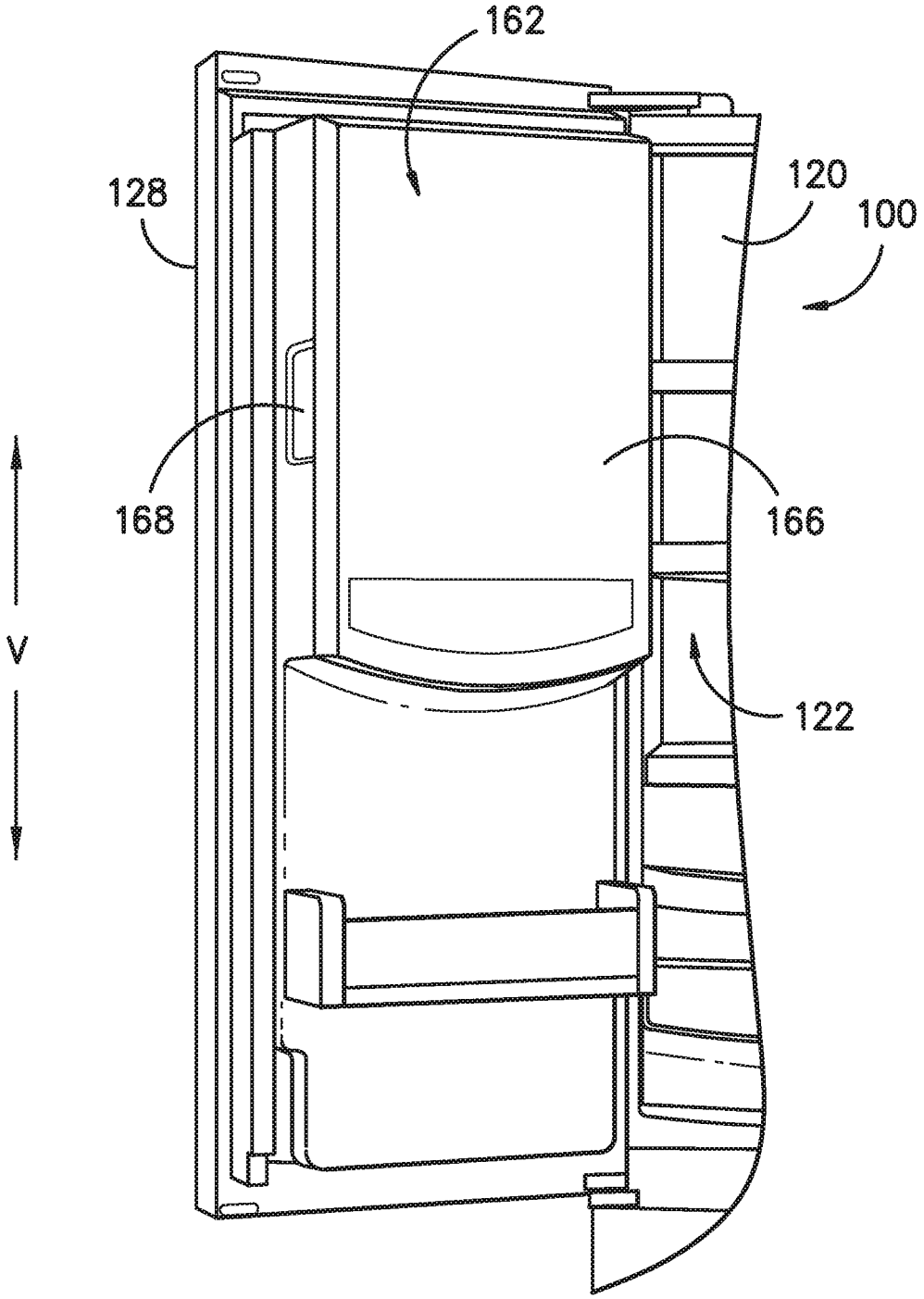
FIG. 2 provides a perspective view of a door of the exemplary refrigerator appliance of FIG. 1.
Figure 3:
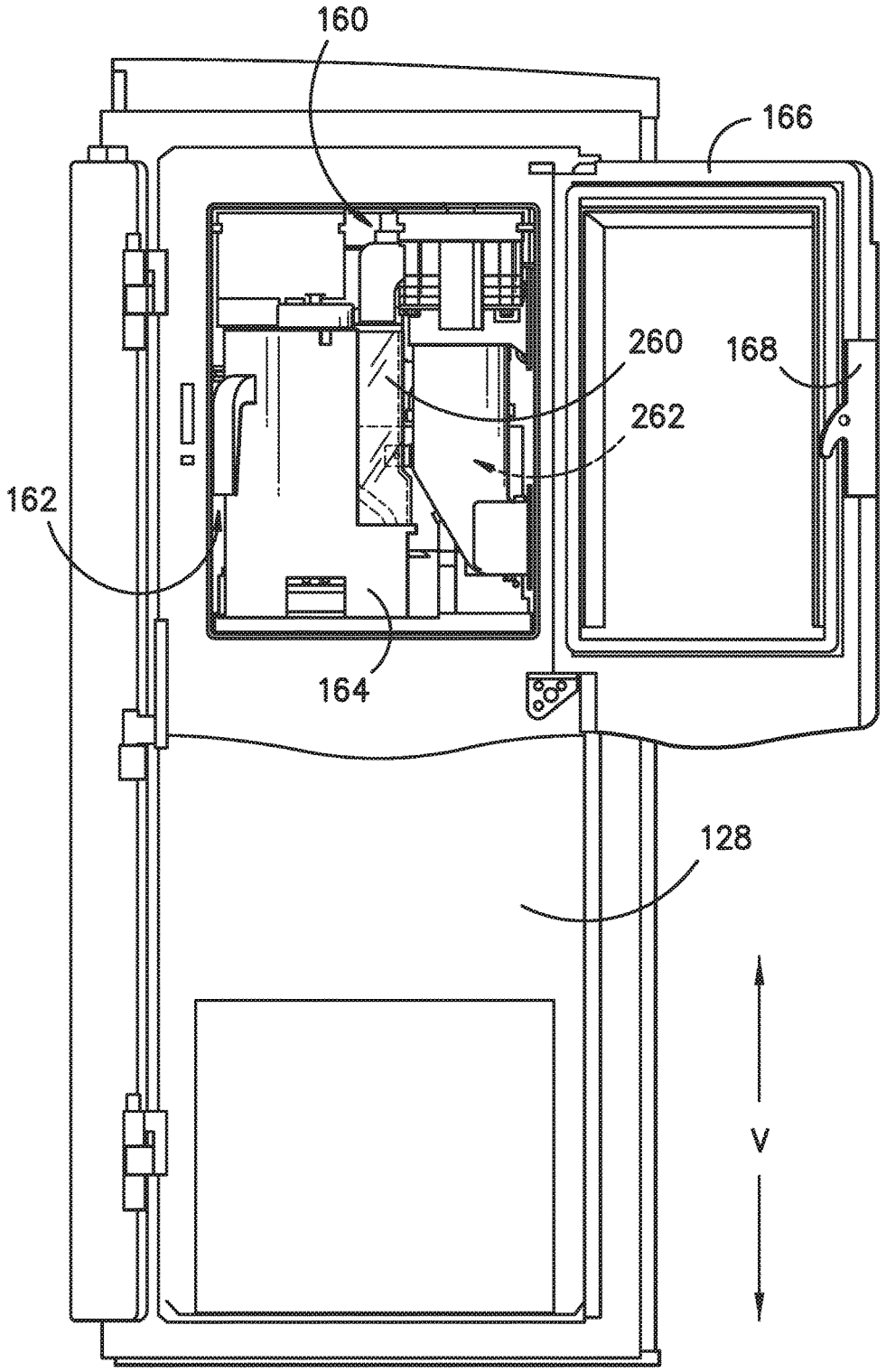
FIG. 3 provides an elevation view of the door of the exemplary refrigerator appliance of FIG. 2 with an access door of the door shown in an open position.

FIG. 2 provides a perspective view of a door of refrigerator doors 128. FIG. 3 provides an elevation view of refrigerator door 128 with an access door 166 shown in an open position. Refrigerator appliance 100 includes a freezer sub-compartment 162 defined on refrigerator door 128. Freezer sub-compartment 162 is often referred to as an "icebox." Freezer sub-compartment 162 extends into fresh food chamber 122 when refrigerator door 128 is in the closed position.

As may be seen in FIG. 3, an ice maker or ice making assembly 160 and an ice storage bin or ice bucket 164 are positioned or disposed within freezer sub-compartment 162. Thus, ice is supplied to dispenser recess 150 (FIG. 1) from the ice making assembly 160 and/or ice bucket 164 in freezer sub-compartment 162 on a back side of refrigerator door 128.

Access door 166 is hinged to refrigerator door 128. Access door 166 permits selective access to freezer sub-compartment 162. Any manner of suitable latch 168 is configured with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162.

Chilled air from a sealed system (not shown) of refrigerator appliance 100 may be directing into ice making assembly 160 in order to cool ice making assembly 160. During operation of ice making assembly 160, chilled air from the sealed system cools components of ice making assembly 160, such as a casing or mold body of ice making assembly 160, to or below a freezing temperature of liquid water. Thus, ice making assembly 160 is an air cooled ice making assembly.

Chilled air from the sealed system also cools ice bucket 164. In particular, air around ice bucket 164 can be chilled to a temperature suitable for storing ice within sub-compartment 162. For example, cooling air may reduce the temperature within sub-compartment 162 below the freezing temperature of water. Alternatively, the temperature within sub-compartment 162 may be maintained above the freezing temperature of water, e.g., to about the temperature of fresh food chamber 122. By maintaining sub-compartment 162 at a temperature greater than the freezing temperature of water, ice nuggets stored ice bucket 164 have a reduced tendency to clump or freeze together. However, due to the temperature of ice bucket 164, ice nuggets therein can melt over time and generate liquid water in ice bucket 164.

Therefore, ice bucket 164 also includes a drain (not shown) that directs water out of ice bucket 164. In this manner, water is prevented or hindered from collecting within ice bucket 164. In addition, water generated during melting of ice nuggets may be recirculated to produce more ice or used for other purposes in refrigerator appliance 100. For example, drained water can flow out of ice bucket 164 and may be directed to an evaporation pan 172 (FIG. 1). Evaporation pan 172 is positioned within a mechanical compartment 170 defined by housing 120, e.g., at bottom portion 102 of housing 120. A condenser 174 of the sealed system can be positioned, e.g., directly, above and adjacent evaporation pan 172. Heat from condenser 174 can assist with evaporation of water in evaporation pan 172. A fan 176 configured for cooling condenser 174 can also direct a flow of air across or into evaporation pan 172. Evaporation pan 172 is sized and shaped for facilitating evaporation of liquid water therein. For example, evaporation pan 172 may be open topped and extend across about a width and/or a depth of housing 120.

Figure 4:
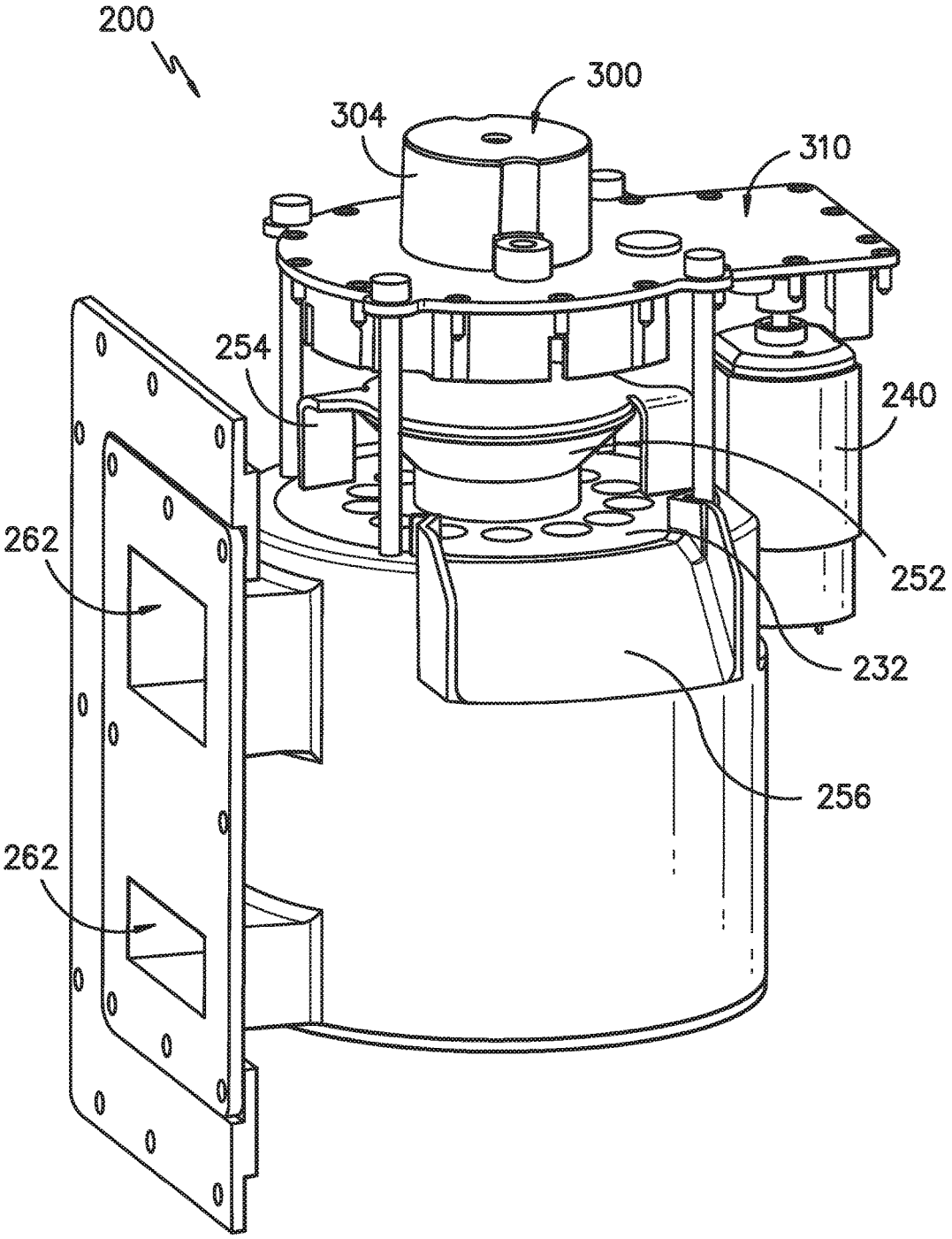
FIG. 4 provides a perspective view of an ice making assembly according to an exemplary embodiment of the present subject matter.
Figure 5:
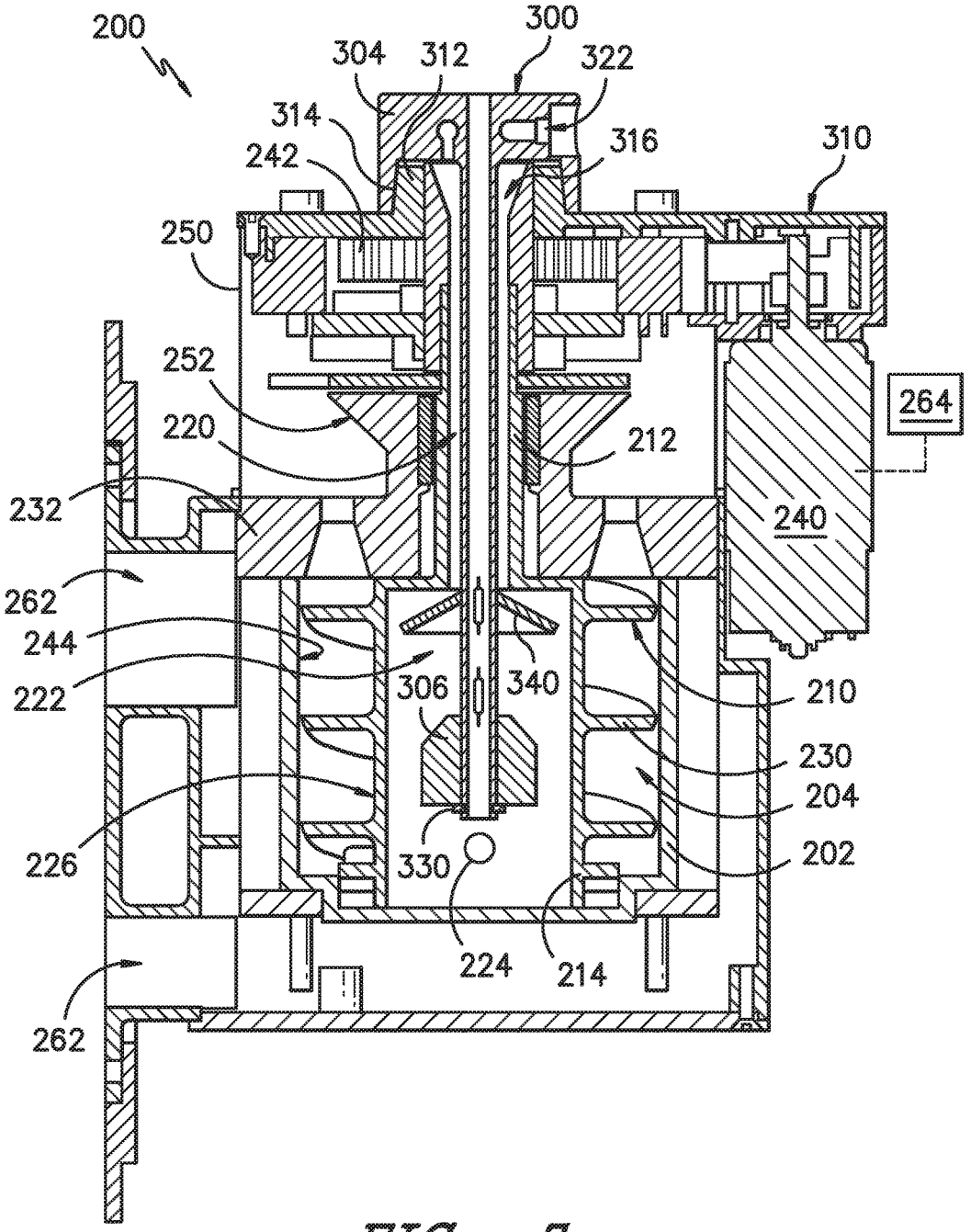
FIG. 5 provides a section view of the exemplary ice making assembly of FIG. 3, with a water level float shown in a lowered position.
Figure 6:
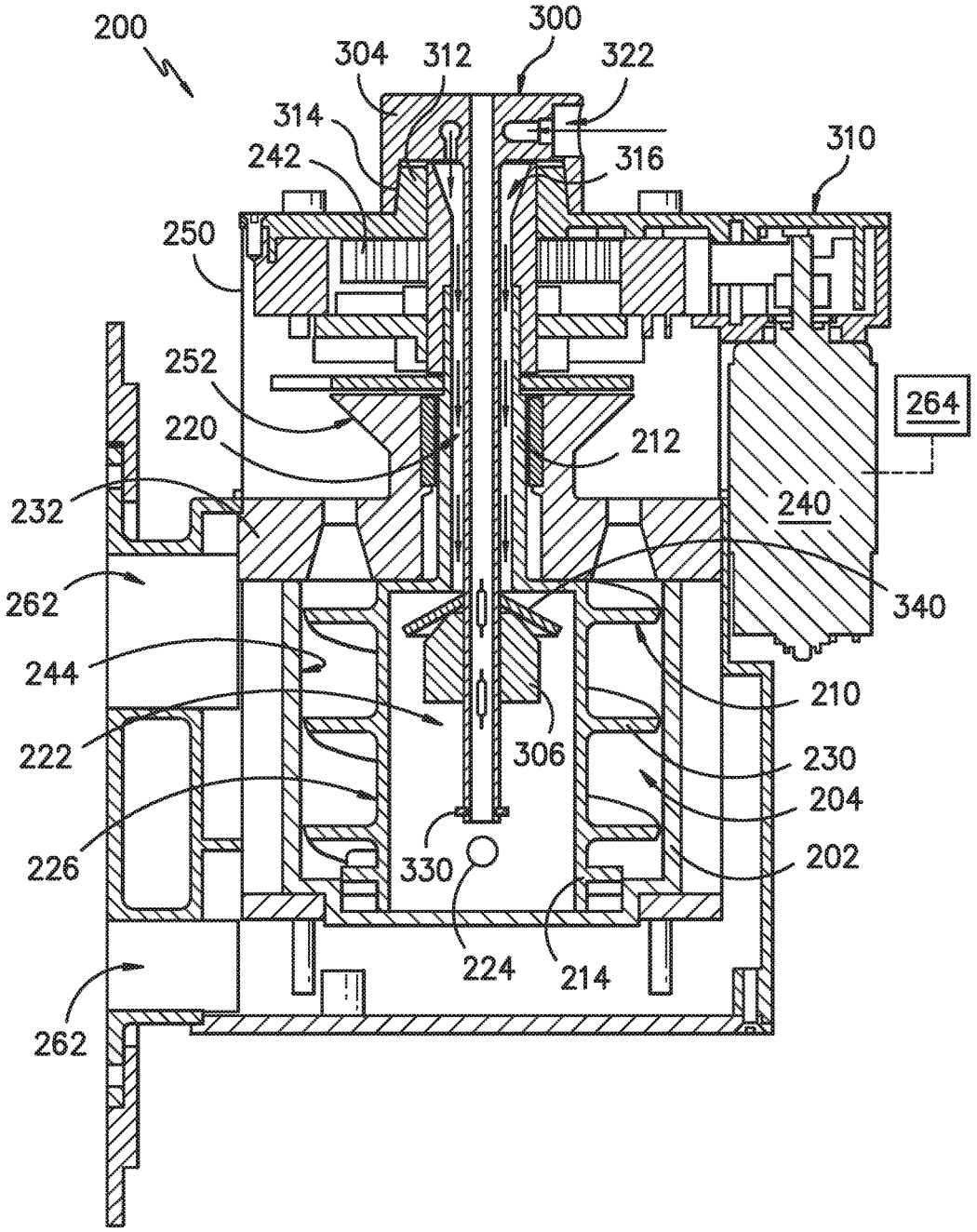
FIG. 6 provides a section view of the exemplary ice making assembly of FIG. 3, with the water level float shown in a raised position.
Figure 7:
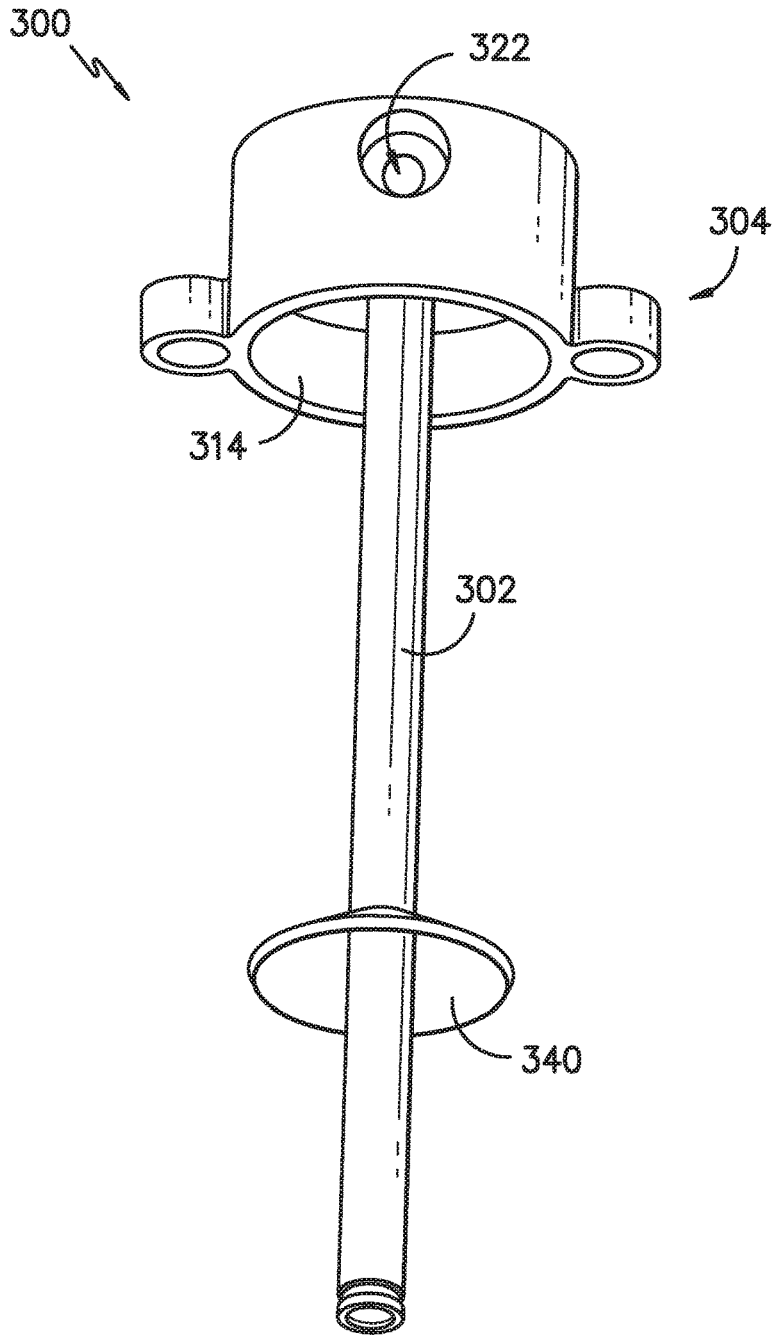
FIG. 7 provides a perspective view of a water switch assembly of the exemplary ice making assembly of FIG. 3 according to an exemplary embodiment of the present subject matter.
Figure 8:
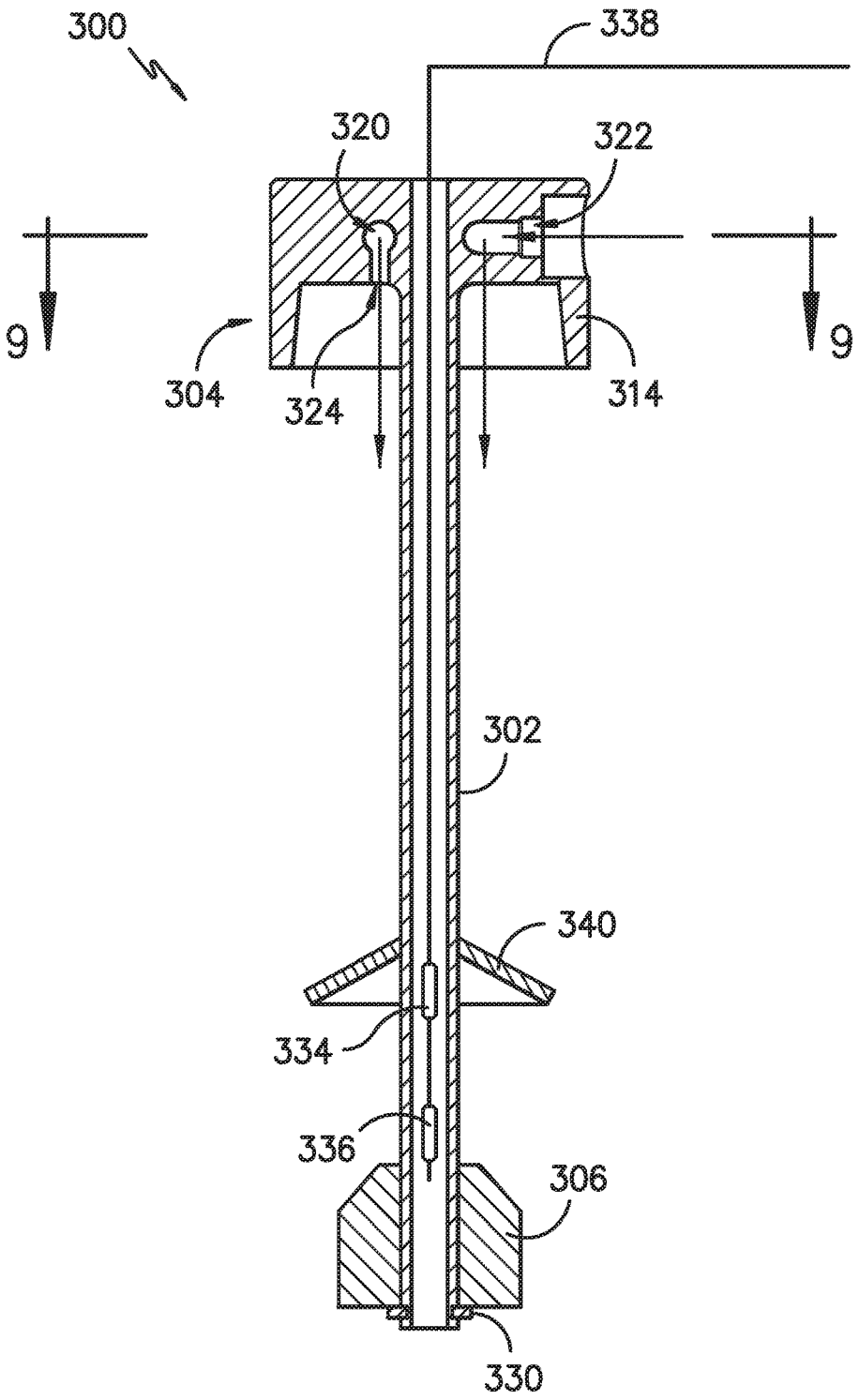
FIG. 8 provides a section view of the exemplary water switch assembly of FIG. 7.
Figure 9:
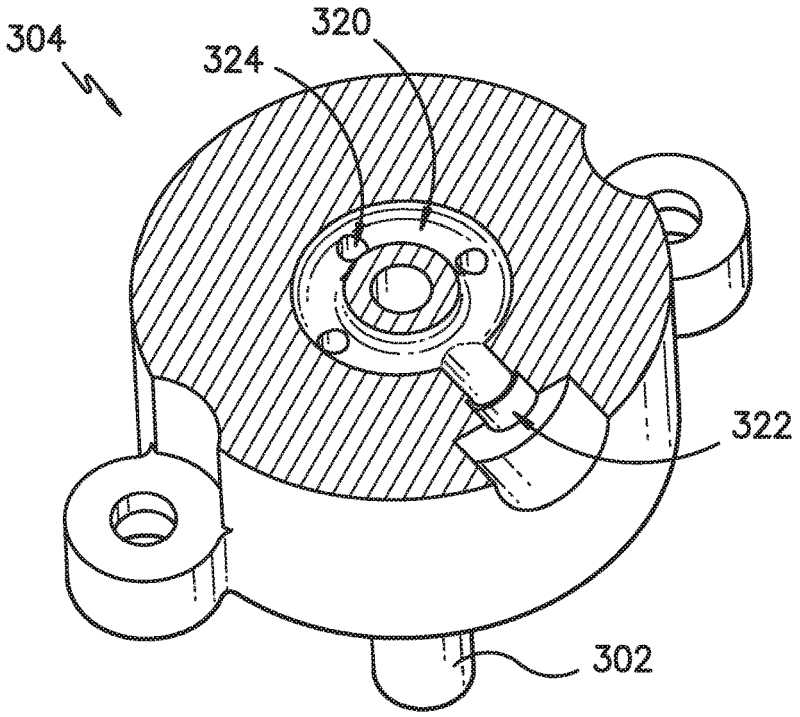
FIG. 9 provides a section view of the exemplary water switch assembly of FIG. 7, taken along Line 9-9 of FIG. 8.
Figure 10:
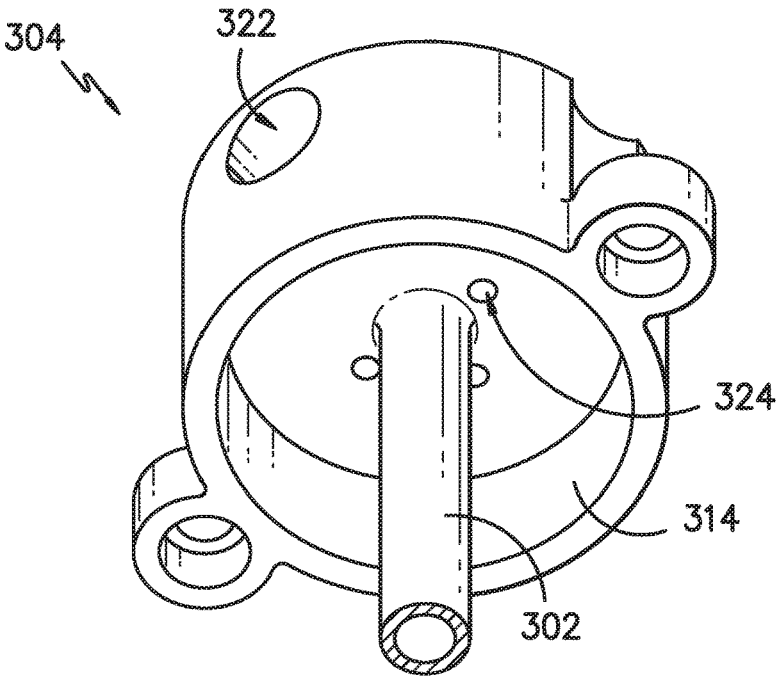
FIG. 10 provides a bottom, perspective view of a switch head assembly of the exemplary water switch assembly of FIG. 7.

Now referring generally to FIGS. 4 through 10, an ice making assembly 200 constructed according to an exemplary embodiment of the present subject matter will be described. FIG. 4 provides a perspective view of ice making assembly 200 and FIGS. 5 and 6 provide section views of ice making assembly 200. One skilled in the art will appreciate that ice making assembly 200 can be used in any suitable refrigerator appliance. For example, ice making assembly 200 may be used in refrigerator appliance 100 as ice making assembly 160 (FIG. 3). In addition, ice making assembly 200 is only used for the purpose of explaining certain aspects of the present subject matter. The features and configurations described may be used for other ice making assemblies as well. Other variations and modifications of the exemplary embodiment described below are possible, and such variations are contemplated as within the scope of the present subject matter.

Ice making assembly 200 includes a mold body or casing 202. Casing 202 may define a cylindrical reservoir 204 configured for receiving water. An ice making auger assembly 210 (FIG. 5) is rotatably mounted within casing 202. In particular, auger assembly 210 may include an auger shaft 212 and an auger head 214. As best shown in FIG. 5 each of auger shaft 212 and auger head 214 are hollow. More specifically, auger shaft 212 and auger head 214 may have a cylindrical shape and define an auger shaft channel 220 and an auger cavity 222.

As will be described in more detail below, water is supplied into auger cavity 222 for the purpose of ice production. Auger head 214 defines one or more apertures 224 to allow water in auger cavity 222 to flow into reservoir 204. According to an exemplary embodiment, auger head 214 defines four apertures 224. Because the pressure head in auger cavity 222 and reservoir 204 is the same, the water level in auger cavity 222 is the same as the water level in the reservoir. Thus, as water is provided into auger cavity 222, the water level in reservoir 204 rises along with the water level in auger cavity 222.

An ice making motor 240 is mounted to casing 202 and is in mechanical communication with (e.g., coupled to) auger assembly 210. Ice making motor 240 is configured for selectively rotating auger assembly 210 within casing 202. Ice making motor 240 may be configured at any location and may directly engage auger assembly 210 or may drive auger assembly 210 through a gear assembly. For example, as shown in FIG. 5, ice making motor 240 is positioned adjacent auger assembly 210 and is parallel to auger assembly 210. Ice making motor 240 engages an auger shaft 212 through a gear assembly including drive gear 242 (other gears have been removed for clarity). Other suitable drive mechanisms for auger assembly 210 are possible and within the scope of the present subject matter.

An outer surface 226 of auger head 214 may define a continuous helical screw 230 that acts as a screw conveyor to urge ice toward an extruder 232 during operation of ice making assembly 200. Therefore, during rotation of auger assembly 210 within casing 202, auger head 214 scrapes or removes ice off an inner surface 244 of casing 202 and directs such ice to extruder 232 to form ice nuggets. More particularly, as best shown in FIG. 5, auger assembly 210 rotates to force ice, or a slurry of ice and water, upward through extruder 232. As the ice is compressed and forced upward through extruder 232, ice cylinders (not shown) are formed. The ice cylinders enter a sweep housing 250 and contact an angled wall 252. Angled wall 252 may assist in breaking the ice cylinders into ice nuggets. The ice nuggets then sit on top of extruder 232 within housing 250.

Referring now back to FIG. 4, housing 250 is removed for clarity, and a sweeper 254 is visible. Sweeper 254 is rotatably mounted within housing 250 and is configured to rotate at a very low speed, e.g., one revolution per minute (RPM). More specifically, sweeper may be in mechanical communication with ice making motor 240, e.g., via a gear assembly. The ice making motor 240 can selectively rotate sweeper 254 within sweep housing 250, and thereby assist with dispensing or removing ice nuggets from sweep housing 250.

Rotation of the sweeper 254 within sweep housing 250 moves the ice nuggets through an opening in housing 250 that is adjacent an ice chute 256. As best shown in FIG. 4, ice chute 256 is sized for directing ice nuggets out of sweep housing 250. In this manner, the ice nuggets exit sweep housing 250, slide down ice chute 256, and are dispensed into ice bucket 164. According to alternative embodiments, ice making assembly 200 may further include an ice nugget conduit instead of, or in addition to, ice chute 256. Moreover, other suitable means for collecting and storing extruded ice are contemplated and within the scope of the present subject matter. From ice bucket 164, the ice nuggets can enter dispensing assembly 140 (FIG. 1) and be accessed by a user as discussed above. In such a manner, ice making assembly 200 can produce or generate ice nuggets.

Ice making assembly 200 and its components may be constructed in any suitable manner and from any suitably rigid material or materials. For example, ice bucket 164 may be constructed with a single molded material, e.g., plastic. In addition, ice bucket 164 may be constructed of multiple components including a window 260 (FIG. 3) that permits a user of ice bucket 164 to view its storage volume. Casing 202, extruder 232, and sweeper 254 are typically constructed from a suitable metal, such as steel. Auger assembly 210 may be constructed from any suitably rigid material, such as plastic or steel. In addition, auger assembly 210 may be constructed as a single, unitary component, or may be an assembly of multiple parts. Sweep housing 250 may be constructed of plastic. However, according to alternative embodiments, each component may be constructed of any suitably rigid material.

According to an alternative exemplary embodiment, ice making assembly may include a fan (not shown) configured for directing a flow of chilled air through a housing or duct 262 towards casing 202. As an example, the fan can direct chilled air from an evaporator of a sealed system through duct 262 to casing 202. Thus, casing 202 can be cooled with chilled air from the fan such that ice making assembly 200 is air cooled in order to form ice therein. According to some exemplary embodiments, ice making assembly 200 may also include a heater (not shown), such as an electric resistance heating element, mounted to casing 202. The heater may be configured for selectively heating casing 202, e.g., when ice prevents or hinders rotation of auger assembly 210 within casing 202.

Operation of ice making assembly 200 is controlled by a processing device or controller 264, e.g., that may be operatively coupled to control panel 148 for user manipulation to select features and operations of ice making assembly 200. Controller 264 can operate various components of ice making assembly 200 to execute selected system cycles and features. For example, controller 264 is in operative communication with ice making motor 240 and other components of ice making assembly 200. Thus, controller 264 can selectively activate and operate ice making motor 240 during the ice making process.

Controller 264 may include a memory and microprocessor, such as a general or special purpose microprocessor operable to execute programming instructions or micro-control code associated with operation of ice making assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 264 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Ice making motor 240 may be in communication with controller 264 via one or more signal lines or shared communication busses.

Ice making assembly 200 may also include one or more temperature sensors (not shown). For example, temperature sensors may be configured for measuring a temperature of casing 202 and/or liquids, such as liquid water, within casing 202. Such temperature sensors may be any suitable device for measuring the temperature of components of ice making assembly 200 or liquids therein. For example, the temperature sensors may be thermistors or thermocouples. Controller 264 can receive a signal, such as a voltage or a current, from the temperature sensors that correspond to the temperature of the temperature of casing 202 and/or liquids therein. In such a manner, the temperature of casing 202 and/or liquids therein can be monitored and/or recorded with controller 264.

Referring again to FIGS. 5 through 10, a water switch assembly 300 for controlling the level of water within reservoir 204 and auger cavity 222 will be described. Water switch assembly 300 may include a switch shaft 302 having a switch head assembly 304 and a water level float 306 disposed thereon. Switch shaft 302 may extend vertically within auger assembly 210. More specifically, according the exemplary embodiment illustrated in FIG. 5, switch shaft 302 may extend from auger cavity 222, through auger shaft channel 220, out a top side 310 of sweep housing 250. Notably, switch shaft 302 also extends through drive gear 242, but is not coupled thereto.

According to the exemplary embodiment, top side 310 of sweep housing 250 defines a boss 312 configured to receive a flange 314 of switch head assembly. When assembled, boss 312 and flange 314 flange define a first end of an inlet channel 316 and form a seal to prevent water from leaking between boss 312 and flange 314. Inlet channel 316 is a channel defined at least in part by an inner surface of auger shaft 212 and an outer surface of switch shaft 302. As shown in FIGS. 5 and 6, inlet channel 316 extends from the first end proximate switch head assembly 304 to a second end that opens into auger cavity 222. In this manner, water may flow from switch head assembly 304, through inlet channel 316, and into auger cavity 222, as described below.

Switch head assembly 304 defines an annular chamber 320 in fluid communication with a water inlet 322. A valve (not shown) may be positioned in water inlet 322 and may be configured to open and close water inlet 322 as needed to supply or stop the flow of water into annular chamber 320. Switch head assembly 304 may further define one or more water supply holes 324 that are in fluid communication with annular chamber 320, water inlet 322, and inlet channel 316. When the valve is opened, water may flow into the annular chamber 320 where it is evenly distributed. Water then flows through water supply holes 324 into inlet channel 316, and into auger cavity 222 (as indicated by the arrows in FIG. 6).

As illustrated in FIGS. 5 and 6, water level float 306 is slidably mounted on switch shaft 302 within auger cavity 222. A retaining clip, such as a snap ring or retaining ring 330, may be attached to the end of switch shaft 302 to prevent water level float 306 from sliding off of the end. Water level float 306 may slide up and down switch shaft 302 as the water level rises and lowers, thereby providing an indication of the current water level within auger cavity 222 and reservoir 204.

One or more sensors may be positioned on or within switch shaft 302 to sense the location of water level float 306. For example, according to the illustrated embodiment, an upper level reed switch 334 is located within switch shaft 302 at a level corresponding to a maximum desired fill level of reservoir 204. Similarly, lower level reed switch 336 is located within switch shaft 302 at a level corresponding to a minimum desired fill level of reservoir 204. Water level float 306 may be magnetic or have a magnetic attachment that triggers reed switches 334, 336 as it slides proximate to them on switch shaft 302. Reed switches 334, 336 may be in electrical communication with controller 264 via any suitable electrical connection, e.g., wires 338, which may pass through the center of switch shaft 302.

During operation, water switch assembly 300 maintains the water level of in reservoir 204 at a desired level for optimum performance of ice making assembly 200. More particularly, according to the illustrated exemplary embodiment, water switch assembly is configured to open a water valve when the water level in reservoir 204 causes water level float 306 to drop below lower level reed switch 336 (see FIG. 5). When this occurs, water enters water inlet 322 from a water supply and enters annular chamber 320. Water is distributed within annular chamber 320 and exits a plurality of water supply holes 324 into inlet channel 316. The water then flows into auger cavity 222 which is in fluid communication with reservoir 204 via apertures 224. When the water level in reservoir 204 raises to a maximum fill amount, water level float 306 passes upper level reed switch 334 (see FIG. 6), which provides an indication to controller 264 to shut off the water valve and stop water from flowing into water inlet 322.

Notably, as water flows through inlet channel 316 into auger cavity 222, it may have the tendency to push water level float 306 downward, resulting in inaccurate water level measurements. Therefore, according to the exemplary embodiment illustrated in FIGS. 5 through 10, water switch assembly 300 further includes a deflector plate 340. Deflector plate 340 is fixed to switch shaft 302 and extends radially from switch shaft 302. In addition, deflector plate 340 may be angled downward as shown according to some embodiments. In this manner, deflector plate 340 deflects water around water level float 306 into auger cavity 222, thereby preventing inaccurate water level measurements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly that defines a vertical direction, comprising:

a casing in thermal communication with a sealed system, the interior of the casing defining a reservoir configured to receive water;

an auger assembly rotatably mounted within the casing, the auger assembly comprising:

a hollow auger shaft;

an auger head disposed on the auger shaft and defining an auger cavity in fluid communication with the reservoir; and a motor operably coupled with the auger shaft proximate a top of the auger shaft and configured for selectively rotating the auger assembly within the casing; and a water switch assembly configured for controlling the water level within the auger cavity and the reservoir, the water switch assembly comprising:

a switch head assembly having a water inlet in fluid communication with a water supply and configured to provide the auger cavity with water;

a switch shaft extending from the switch head assembly through the hollow auger shaft and being fixed along the vertical direction; and a float slidably received on the switch shaft within the auger cavity, the float configured to measure the water level within the auger cavity.

2. The ice making assembly of claim 1, further comprising a valve configured to open the water supply when the float indicates a water level below a predetermined lower threshold and close the water supply when the float indicates a water level above a predetermined upper threshold.

3. The ice making assembly of claim 2, wherein the water switch assembly comprises a reed switch positioned within the switch shaft configured for determining the position of the float.

4. The ice making assembly of claim 3, wherein the reed switch is a first reed switch that is positioned in the switch shaft such that it is activated when the float reaches the predetermined lower threshold, the water switch further comprising a second reed switch that is positioned in the switch shaft such that it is activated when the float reaches the predetermined upper threshold.

5. The ice making assembly of claim 1, wherein the switch head assembly comprises an annular chamber that surrounds the switch shaft, the annular chamber being in fluid communication with the water inlet and the water supply.

6. The ice making assembly of claim 5, wherein the annular chamber defines a plurality of water supply holes that direct water from the annular chamber between the switch shaft and the auger shaft into the auger cavity.

7. The ice making assembly of claim 1, wherein the water switch assembly further comprises a deflector plate disposed on the switch shaft between the switch head assembly and the float, the deflector plate deflecting water around the float.

8. The ice making assembly of claim 1, wherein the auger assembly further comprises a drive gear operably coupling the auger shaft with the motor, and wherein the switch shaft passes through a center of the drive gear.

9. The ice making assembly of claim 1, wherein the auger head defines a plurality of apertures to provide fluid communication between the auger cavity and the reservoir.

10. The ice making assembly of claim 1, wherein the switch head assembly is disposed above the auger assembly.

11. A water switch assembly for an ice making assembly, the ice making assembly comprising an auger rotatably mounted in a reservoir defined by a casing, the auger being disposed on an auger shaft and defining an auger cavity in fluid communication with the reservoir, the water switch assembly comprising:

a switch head assembly having a water inlet in fluid communication with a water supply and configured to provide the auger cavity with water;

a switch shaft extending from the switch head assembly through the auger shaft and being fixed along a vertical direction relative to the switch head assembly; and a float slidably received on the switch shaft within the auger cavity, the float configured to measure the water level within the auger cavity.

12. The water switch assembly of claim 11, further comprising a valve configured to open the water supply when the float indicates a water level below a predetermined lower threshold and close the water supply when the float indicates a water level above a predetermined upper threshold.

13. The water switch assembly of claim 12, further comprising a reed switch positioned within the switch shaft and configured for determining the position of the float.

14. The water switch assembly of claim 13, wherein the reed switch is a first reed switch that is positioned in the switch shaft such that it is activated when the float reaches the predetermined lower threshold, the water switch further comprising a second reed switch that is positioned in the switch shaft such that it is activated when the float reaches the predetermined upper threshold.

15. The water switch assembly of claim 11, wherein the switch head assembly comprises an annular chamber that surrounds the switch shaft, the annular chamber being in fluid communication with the water inlet and the water supply.

16. The water switch assembly of claim 15, wherein the annular chamber defines a plurality of water supply holes that direct water from the annular chamber between the switch shaft and the auger shaft into the auger cavity.

17. The water switch assembly of claim 11, further comprising a deflector plate disposed on the switch shaft between the switch head assembly and the float, the deflector plate deflecting water around the float.

18. The water switch assembly of claim 11, wherein the auger shaft is operably couple to a drive motor by a drive gear, and wherein the switch shaft passes through a center of the drive gear.

19. The water switch assembly of claim 11, wherein the auger defines a plurality of apertures to provide fluid communication between the auger cavity and the reservoir.

20. The water switch assembly of claim 11, wherein the switch head assembly is disposed above the auger and the auger shaft.

* * * * *